US006744026B2

(12) United States Patent
Ishikawa

(10) Patent No.: US 6,744,026 B2
(45) Date of Patent: Jun. 1, 2004

(54) MICROWAVE OVEN FOR EASILY SETTING FOOD MENU REQUIRED TO BE COOKED

(75) Inventor: Kazuhiko Ishikawa, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 142 days.

(21) Appl. No.: 10/070,834

(22) PCT Filed: Jun. 20, 2001

(86) PCT No.: PCT/JP01/05285

§ 371 (c)(1),
(2), (4) Date: Mar. 11, 2002

(87) PCT Pub. No.: WO02/04867

PCT Pub. Date: Jan. 17, 2002

(65) Prior Publication Data

US 2002/0121514 A1 Sep. 5, 2002

(30) Foreign Application Priority Data

Jul. 12, 2000 (JP) ..... 2000-211369

(51) Int. Cl.[7] ..... H05B 6/68

(52) U.S. Cl. ..... 219/702; 219/720; 219/714; 219/506; 99/325; 700/207

(58) Field of Search ..... 219/720, 702, 219/714, 506; 99/325; 700/207, 211, 17

(56) References Cited

U.S. PATENT DOCUMENTS 4,841,125 A * 6/1989 Edamura ..... 219/506
6,064,050 A 5/2000 Ishikawa et al. ..... 219/720
6,097,016 A 8/2000 Hirata et al.

FOREIGN PATENT DOCUMENTS

| | | | | |
|---|---|---|---|---|
| EP | 0 965 795 A2 | | 12/1999 | |
| JP | 57-150736 A | | 9/1982 | |
| JP | 9-176525 A | | 10/1984 | |
| JP | 63-251728 | * | 10/1988 | ..... 219/714 |
| JP | 2-119809 | | 5/1990 | |
| JP | 4-174220 A | | 6/1992 | |
| JP | 11-281064 A | | 10/1999 | |
| JP | 2000-65357 A | | 3/2000 | |
| JP | 2000-97438 A | | 4/2000 | |
| JP | 2000-134676 A | | 5/2000 | |

* cited by examiner

*Primary Examiner*—Philip H. Leung
(74) *Attorney, Agent, or Firm*—Birch, Stewart, Kolasch & Birch, LLP

(57) ABSTRACT

Cooking information (CI) concerning different dishes is preliminarily registered as a standard in a mask ROM (11A) or the like of a microwave oven (1), to enable automatic cooking of a variety of dishes for every user. In practice, however, the dishes which each user cooks by a microwave oven is limited to a few of them. Then, the user selects and registers a standard recipe name (HN) of only his/her favorite dish in the mask ROM into a favorite menu in a non-volatile memory (11B). In order to execute cooking of a desired dish registered in the favorite menu, the standard recipe name of the desired dish is read not from the mask ROM but from the non-volatile memory and displayed on an LCD panel (13), so that the user needs only perform an operation to instruct start of heating through an input unit (15).

7 Claims, 11 Drawing Sheets

CI — 11A (103)

| HN | | KI | TI | ZI |
|---|---|---|---|---|
| ⋮ | | | | |
| WARM UP | | ×××  | ○○× | △△× |
| MILK | | ×○× | ×△× | ××○ |
| SAKE | | △△△ | ○×○ | ××○ |
| ⋮ | | | | |
| POT-STEAMED HOTCHPOTCH | | △△ | ×○ | ××× |
| ⋮ | | | | |
| SPONGE CAKE | 18cm | ○○× | △△× | ××○ |
| | 21cm | ○○△ | △×△ | ×○× |
| | 15+21cm | ○○○ | ×△△ | ○×× |
| | 18+18cm | ×○○ | △△△ | ○○× |

11B

| HN |
|---|
| WARM UP |
| MILK |
| SAKE |
| MEAT DEFROST |
| POT-STEAMED HOTCHPOTCH |
| SPONGE CAKE 18cm |

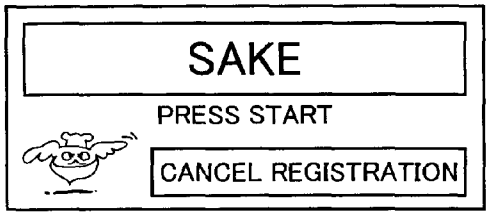
FIG.5A
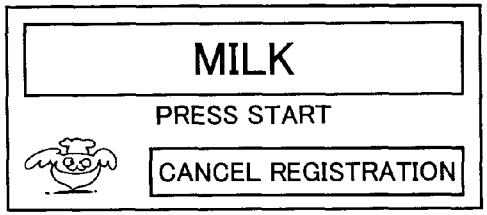
FIG.5B
FIG.5C
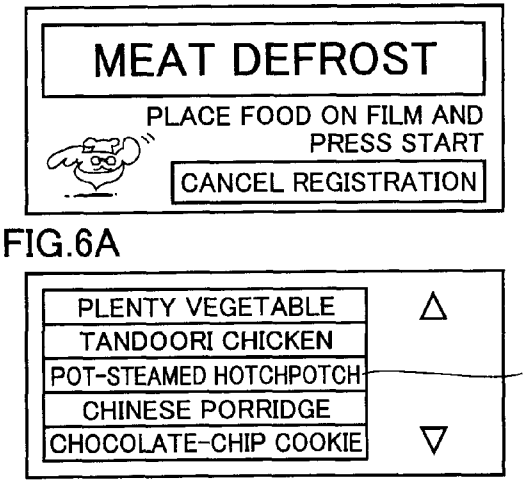
FIG.5D
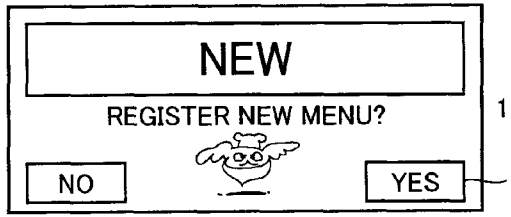
FIG.5E
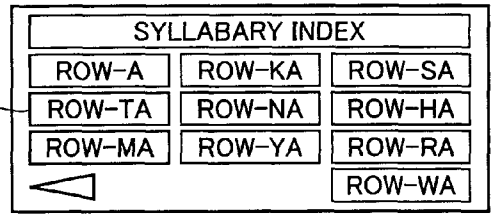
FIG.5F
FIG.6A
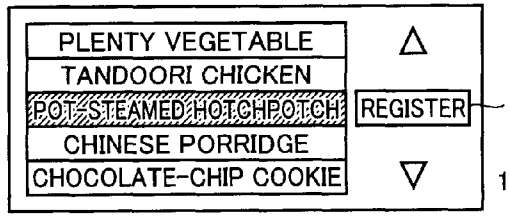
FIG.6B
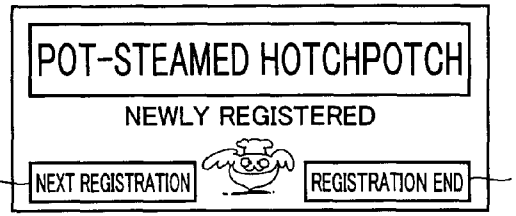
FIG.6C
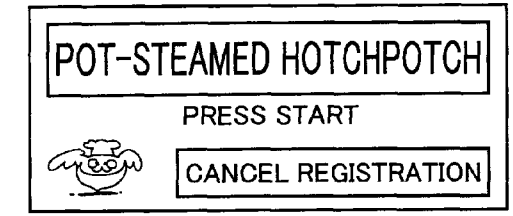
FIG.6D

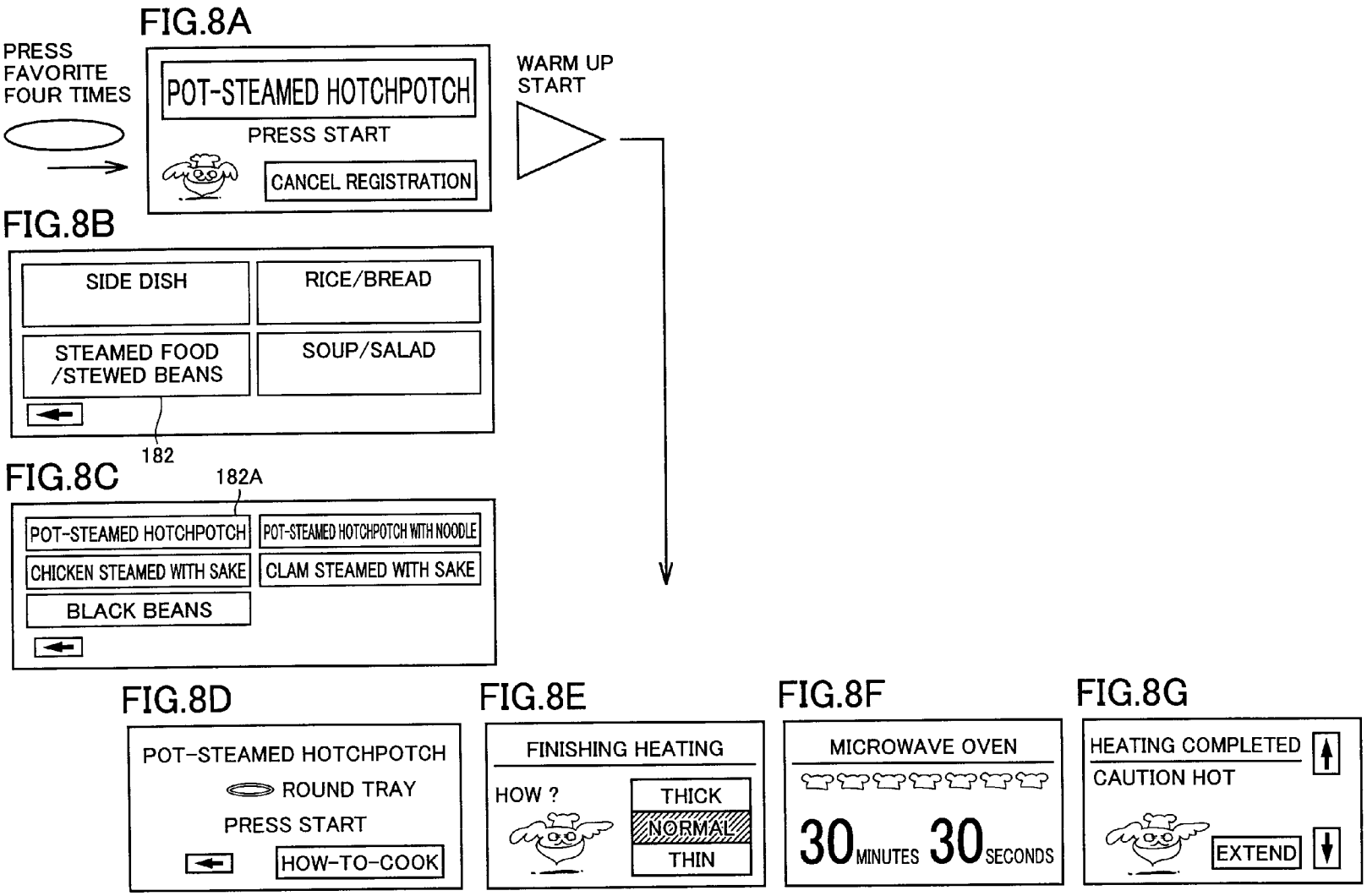
PRESS FAVORITE FOUR TIMES
FIG.8A
POT-STEAMED HOTCHPOTCH
PRESS START
CANCEL REGISTRATION
WARM UP START
FIG.8B
SIDE DISH
RICE/BREAD
STEAMED FOOD /STEWED BEANS
SOUP/SALAD
182
FIG.8C
182A
POT-STEAMED HOTCHPOTCH
POT-STEAMED HOTCHPOTCH WITH NOODLE
CHICKEN STEAMED WITH SAKE
CLAM STEAMED WITH SAKE
BLACK BEANS
FIG.8D
POT-STEAMED HOTCHPOTCH
ROUND TRAY
PRESS START
HOW-TO-COOK
FIG.8E
FINISHING HEATING
HOW ?
THICK
NORMAL
THIN
FIG.8F
MICROWAVE OVEN
30 MINUTES 30 SECONDS
FIG.8G
HEATING COMPLETED
CAUTION HOT
EXTEND

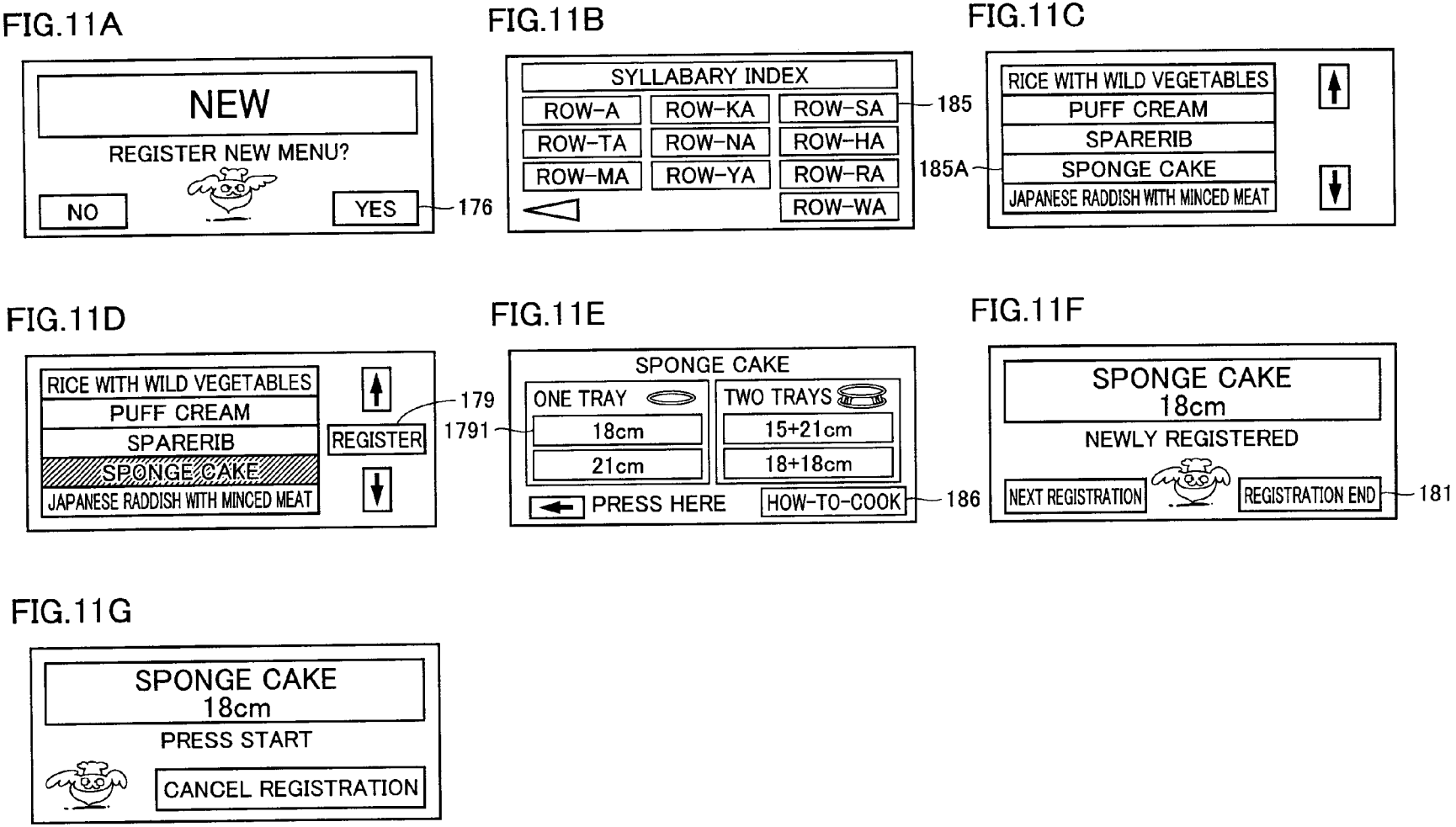
FIG.11A
NEW
REGISTER NEW MENU?
NO
YES
176
FIG.11B
SYLLABARY INDEX
ROW-A
ROW-KA
ROW-SA
ROW-TA
ROW-NA
ROW-HA
ROW-MA
ROW-YA
ROW-RA
ROW-WA
185
FIG.11C
RICE WITH WILD VEGETABLES
PUFF CREAM
SPARERIB
SPONGE CAKE
JAPANESE RADDISH WITH MINCED MEAT
185A
FIG.11D
RICE WITH WILD VEGETABLES
PUFF CREAM
SPARERIB
SPONGE CAKE
JAPANESE RADDISH WITH MINCED MEAT
REGISTER
179
1791
FIG.11E
SPONGE CAKE
ONE TRAY
18cm
21cm
TWO TRAYS
15+21cm
18+18cm
PRESS HERE
HOW-TO-COOK
186
FIG.11F
SPONGE CAKE
18cm
NEWLY REGISTERED
NEXT REGISTRATION
REGISTRATION END
181
FIG.11G
SPONGE CAKE
18cm
PRESS START
CANCEL REGISTRATION

MICROWAVE OVEN FOR EASILY SETTING FOOD MENU REQUIRED TO BE COOKED

This application is the national phase under 35 U.S.C. §371 of PCT International Application No. PCT/Jp01/05285 which has an International filing date of Jun. 20, 2001, which designated the United States of America.

TECHNICAL FIELD

The present invention relates to a microwave oven, and more specifically to a microwave oven allowing easy setting of a cooking menu for which heating and cooking is desired.

BACKGROUND ART

In microwave ovens on the market, for example, information concerning a cooking menu for which heating and cooking can be automatically performed by the microwave ovens is stored in advance. More than 100 types of recipe names, for example, are registered in this menu, so that the operation for the user to find the desired recipe name in the menu is complicated and thus not user-friendly. Especially when elderly people specify a desired recipe name in the displayed menu, it is difficult to search the desired recipe name because the recipe names are displayed in small letters, resulting in unpractical performance.

A cooker in which a method of displaying selected recipe names is improved is disclosed in Japanese Patent Laying-Open No. 2-119809. Since this cooker continues to display a recipe name once selected, after completion of cooking according to the recipe, the user can know what dish is in the cooker by identifying the displayed recipe name. In the cooker, however, only the period during which a recipe name for cooking is displayed has been improved, and no improvement in the operation to select a recipe name is shown.

DISCLOSURE OF THE INVENTION

An object of the present invention is to provide a highly practical microwave oven.

A microwave oven in accordance with one aspect of the present invention includes a storing unit at which cooking information including heating control information corresponding to each of a plurality of dishes for heating and cooking the dishes is registered as a standard.

The microwave oven further includes: a display unit; a recipe name storing unit storing recipe names of one or more dishes selected from the plurality of dishes; an external operation unit having at least a read operation unit operated to read a desired recipe name from the recipe names in the recipe name storing unit, for display on the display unit, and a heating start operation unit operated to instruct start of a heating operation for cooking; a desired recipe name displaying unit displaying on the display unit the desired recipe name read from the recipe name storing unit in response to the read operation unit being operated; and a desired dish heating unit for starting the heating operation according to heating control information corresponding to the dish of the desired recipe name in response to the heating start operation unit being operated, when the desired recipe name is being displayed on the display unit by the desired recipe name displaying unit.

In accordance with the above-described microwave oven, when the read operation unit is operated, the desired recipe name is read from the recipe name storing unit and displayed on the display unit. Then, when the heating start operation unit is operated, the heating operation for heating and cooking is started according to the heating control information corresponding to the desired dish.

This results in the following features. Specifically, in the storing unit of the microwave oven, standard cooking information concerning the plurality of dishes would be registered to enable automatic heating and cooking of widely-ranging dishes for every user. In practice, however, the dishes that the user may cook are limited to some of them. In the microwave oven in accordance with the present invention, heating and cooking of the user's favorite desired dish which is frequently heated and cooked is executed simply by reading the desired recipe name not from the storing unit but from the recipe name storing unit which stores a recipe name of a dish selected from the plurality of dishes in the storing unit and by instructing start of the heating operation. Therefore, as compared with selecting a desired dish from a large amount of cooking information in the storing unit for every user and executing heating and cooking, the operations from selecting and specifying a desired recipe name to starting heating and cooking of the corresponding dish are performed more easily, resulting in practical performance.

In the above-described microwave oven, the desired recipe name displaying unit displays the recipe name in larger letters on the display images. Therefore even elderly users could easily check if the displayed recipe name is the desired recipe name, resulting in practical performance.

In the above-described microwave oven, the cooking information further includes a recipe name corresponding to each of a plurality of standard registered dishes. Then, the microwave oven further includes a recipe name storing control unit reading a recipe name of a desired dish from the storing unit through the external operation unit and storing that name in the desired recipe name storing unit.

Therefore, the user can selectively read and store a desired recipe name, for example, a recipe name of his/her favorite dish frequently cooked, from the storing unit into the desired recipe name storing unit, by operating the external operation unit.

The above-described microwave oven further includes a recipe name deletion control unit deleting a recipe name selected through the external operation unit from the recipe name storing unit. Therefore, it is possible to selectively delete a recipe name stored in the recipe name storing unit as desired and then to store a recipe name of a new desired dish in a space area resulting from deletion by the recipe name storing control unit. In other words, a recipe name stored in the recipe name storing unit can be arbitrarily changed as desired by the user, resulting in practical performance.

In the above-described microwave oven, the desired recipe name displaying unit displays each desired recipe name using a corresponding dedicated image in the display unit. Therefore, a desired recipe name is displayed in a unique manner (unique in a display manner such as graphic size, color and the like) together with a message unique to that dish (a unique message such as a tip message in cooking and the like) on the corresponding dedicated image, so that the user can finish the desired dish more properly with reference to the display content on the dedicated image.

In the above-described microwave oven, the cooking information presents the content according to the servings of a corresponding dish, and corresponding servings are indicated using the recipe name. Therefore, when the finished servings vary for the same dish, storage into the recipe name storing unit, display by the desired recipe name displaying unit, and the like can be performed using a recipe name indicative of servings. Furthermore, heating and cooking can be performed in accordance with cooking information including heating control information corresponding to servings.

In the above-described microwave oven, the heating operation is started to heat and cook a prescribed dish in accordance with heating control information of the prescribed dish that is supplied from website information via a communication network. Therefore, the prescribed dish can be heated and cooked using the heating control information of the prescribed dish that is externally supplied through the communication network.

BRIEF DESCRIPTION OF THE DRAWINGS

FIGS. 5A to 5F show exemplary on-screen displays in registering standard recipe names in a favorite menu, in accordance with the first embodiment of the present invention.

FIGS. 6A to 6D show exemplary on-screen displays in registering standard recipe names in the favorite menu, in accordance with the first embodiment of the present invention.

FIGS. 8A to 8G illustrate displayed images for the favorite menu in accordance with the first embodiment.

FIGS. 11A to 11G illustrate the procedures for registering a standard recipe name indicative of the servings of a dish into the favorite menu in accordance with the first embodiment.

BEST MODE FOR CARRYING OUT THE INVENTION

In the following, embodiments of the present invention will be described.

First Embodiment

Figures 1, 2, 3:
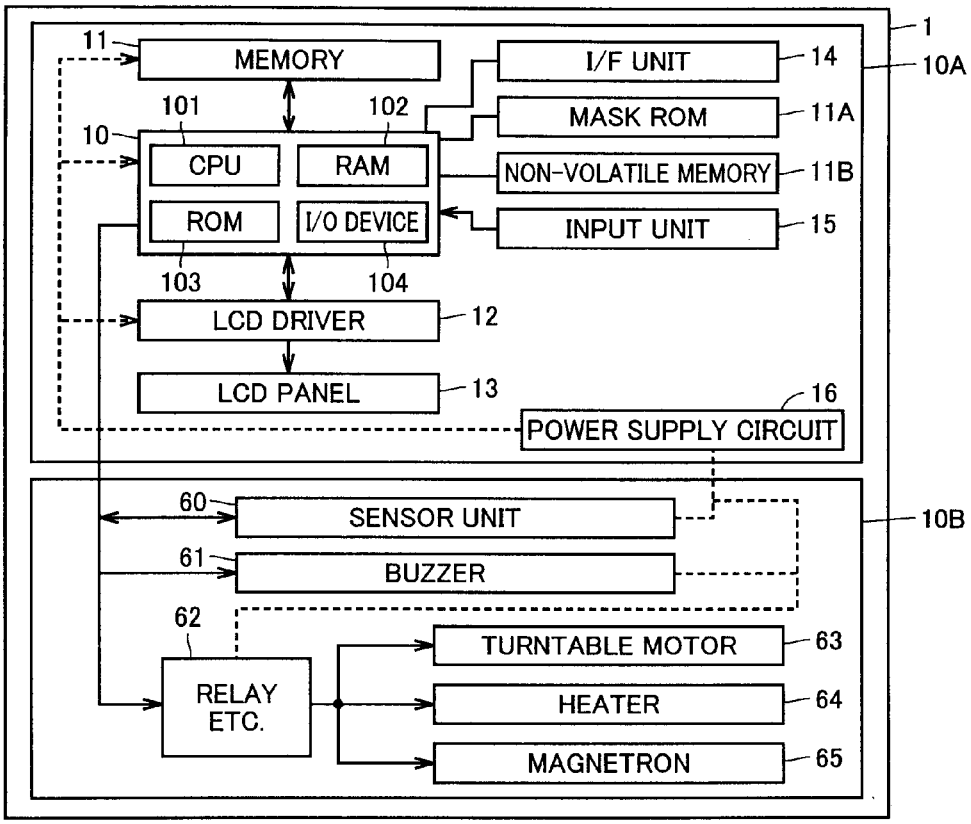
FIG. 1 shows a configuration of a microwave oven in accordance with a first embodiment of the present invention.
FIG. 2 shows an exemplary content stored in a mask ROM 11A and an ROM 103 in FIG. 1.
FIG. 3 shows an exemplary content stored in a non-volatile memory 11B in FIG. 1.

A first embodiment will now be described. In the present embodiment, a microwave oven is not connected with an external device or the like and used alone. FIG. 1 is a configurative illustration of the microwave oven in accordance with the first embodiment of the present invention. In FIG. 1, microwave oven 1 includes a control unit 10A and a heating unit 10B. Control unit 10A includes a microcomputer 10, a memory 1, an LCD (Liquid Crystal Display) panel 13, that is a display unit configured with dots, an LCD driver 12 for driving LCD panel 13, an I/F (interface) unit 14 including an input/output terminal connected with a connector CN, which will be described later, a power supply circuit 16 for supplying power to each unit of the microwave oven 1 and an input unit 15 allowing an external operation, and a mask ROM (Read Only Memory) 11A and a non-volatile memory 11B. Input unit 15 and LCD panel 13 are integrally provided to form a touch panel. Microcomputer 10 includes a CPU (Central Processing Unit) 101 for centrally controlling and monitoring the microwave oven 1 itself, an RAM (Random Access Memory) 102, an ROM 103 and an I/O (input/output) device 104.

Heating unit 10B performs a heating operation for heating and cooking according to a variety of information stored in various kinds of memory in control unit 10A under the control of microcomputer 10. For the heating operation, heating unit 10B includes a sensor unit 60, a buzzer 61, relay etc. 62, and a turntable motor 63, a heater 64 and a magnetron 65 producing a microwave for heating, which are controlled by microcomputer 10 through relay etc. 62. Note that the heating operation in heating unit 10B follows the known technique and the description in detail will not be repeated here.

FIG. 2 shows an exemplary content stored in mask ROM 11A or ROM 103. In FIG. 2, a standard recipe name HN showing the name of a standard dish and cooking information CI are preliminarily registered for each of a plurality of standard dishes in mask ROM 11A or ROM 103 as a standard specification of the microwave oven 1. Cooking information CI includes heating information KI to be referred to for automatic cooking of the standard dish in heating unit 10B of the microwave oven 1, and material information ZI to be displayed on LCD panel 13 for indicating a procedure of how to cook the standard dish. Note that a standard dish refers to a dish preliminarily registered as a standard that can be cooked by microwave oven 1 without the user's registering operation. Information of standard dishes is registered at mask ROM 11A or ROM 103 in accordance with a standard specification at the time of shipment from factories. FIG. 3 shows an exemplary content stored in non-volatile memory 11B in FIG. 1. A favorite menu as described later is stored in non-volatile memory 11B. Standard recipe names HN corresponding to one or more standard dishes particularly favored by the user or frequently cooked, are registered in the favorite menu. Standard recipe names HN of a prescribed number, smaller than those stored in the mask ROM 11A or ROM 103, are registered in the favorite menu. This registration will be detailed later.

Figure 4:
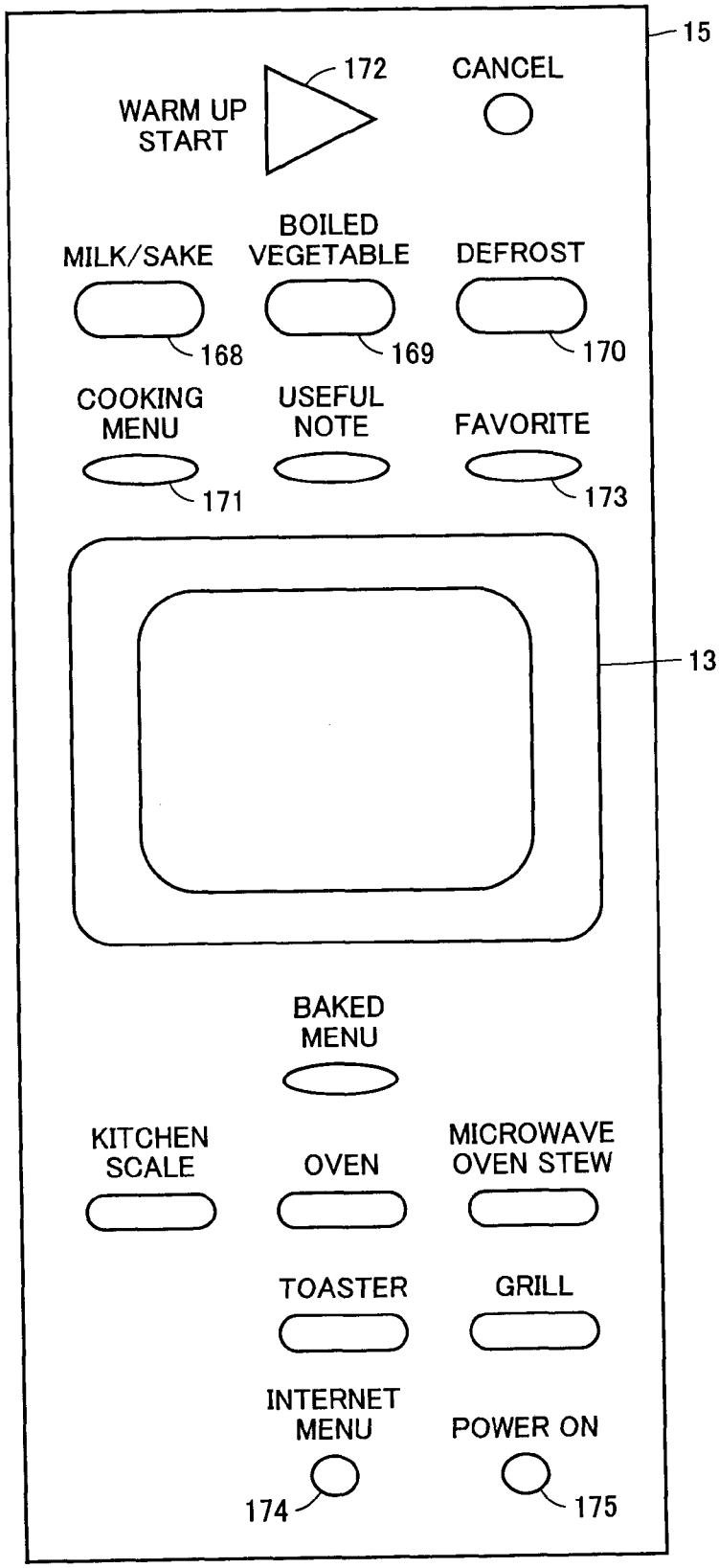
FIG. 4 is an exemplary appearance of an operation unit configured with an input unit 15 and an LCD panel 13 in FIG. 1.

FIG. 4 is an exemplary appearance of an operation unit configured with input unit 15 and LCD panel 13 in FIG. 1. As shown, the front surface of microwave oven 1 is provided with the operation unit integrally formed with input unit 15 and LCD panel 13 for enabling the user to operate externally. Input unit 15 includes a milk/sake key 168, a boiled vegetable key 169, a defrost key 170, a cooking menu key 171, a warm up start key 172, a favorite key 173, an Internet menu key 174, and a power ON key 175 operated to turn on the power.

Milk/sake key 168, boiled vegetable key 169 and defrost key 170 are operated to perform heating and cooking such as warming up milk/sake, boiling vegetables, defrosting frozen food and the like which are preliminarily registered as standard dishes in the microwave oven 1. When these keys are operated, heating information KI for the standard dish corresponding to the operated key is read from mask ROM 11A or ROM 103, and heating and cooking for the standard dish is automatically performed by heating unit 10B under the control of microcomputer 10 in accordance with the read heating information KI.

Cooking menu key 171 is operated to read out a cooking menu consisting of a plurality of standard recipe names HN preliminarily registered in mask ROM 11A or ROM 113 for display on LCD panel 13. Warm up start key 172 is operated to instruct microcomputer 10 to start heating and cooking in accordance with heating information KI for the standard dish specified by the user. Favorite key 173 is operated for the user to specify the standard recipe name HN preliminarily specified as a dish which is frequently cooked by microwave oven 1 or as a particularly favored dish among a plurality of standard dishes preliminarily registered in mask ROM 11A or ROM 103, using the content displayed on LCD panel 13. Internet menu key 174 is operated to cook a desired dish in accordance with the heating information concerning the desired dish downloaded through the Internet as described later.

In the first embodiment, every time the user pushes favorite key 173 in FIG. 4, the corresponding standard recipe names HN preliminarily registered in non-volatile memory 11B as favorite dishes by the user are successively displayed in large characters. Accordingly, when the intended standard recipe name HN is displayed on LCD panel 13, the user may push warm up start key 172 to automatically start heating and cooking in accordance with heating information KI corresponding to the intended standard dish at heating unit 10B under the control of microcomputer 10. In order to implement such a feature, among the standard dish information preliminary registered in mask ROM 11A or ROM 103, the user's favorite standard recipe name HN or the standard recipe name HN specified to be frequently cooked in microwave oven 1 are read out from mask ROM 11A or ROM 103 and registered in non-volatile memory 11B. The description of this procedure will follow.

Figure 7:
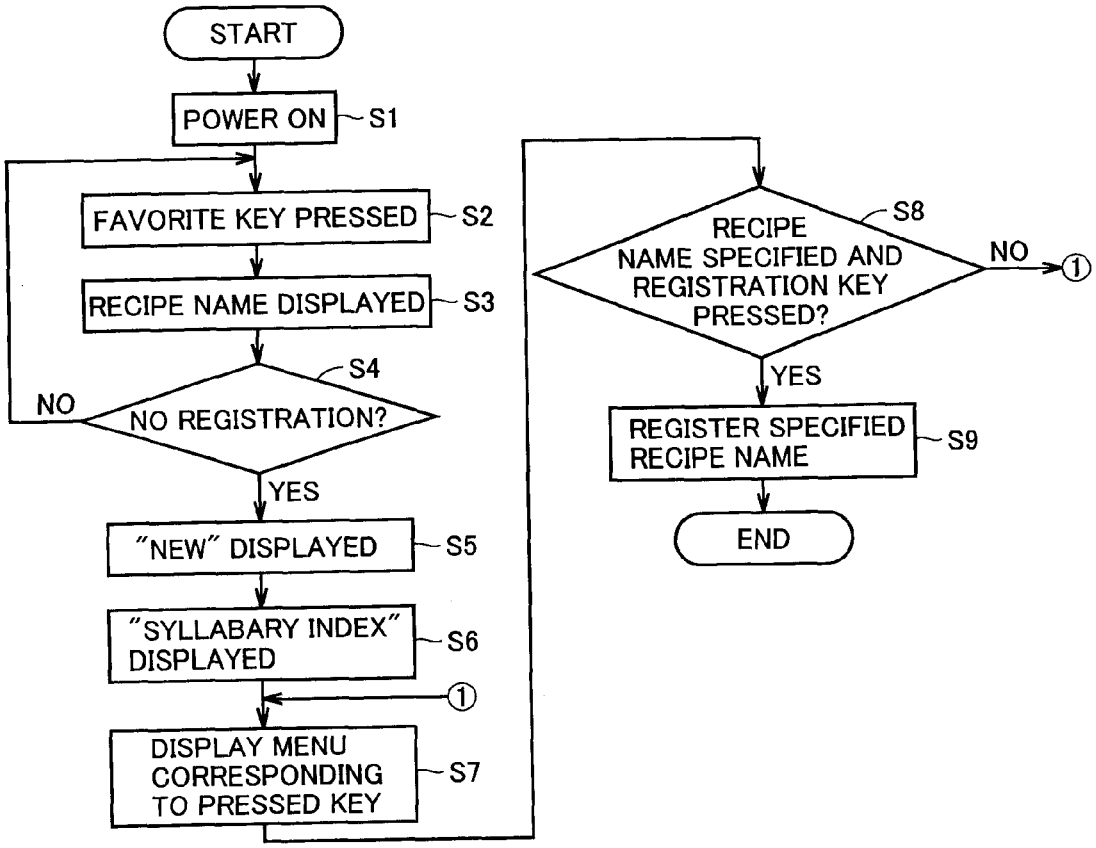
FIG. 7 is a process flow chart in registering a standard recipe name in the favorite menu in accordance with the first embodiment of the present invention.

FIGS. 5A to 5F and FIGS. 6A to 6D illustrate exemplary on-screen displays when standard recipe name HN is registered in the favorite menu in the first embodiment of the present invention. FIG. 7 is a process flow chart when a standard recipe name is registered in the favorite menu in the first embodiment of the present invention. The process for registering "pot-steamed hotchpotch (Tyawanmushi in Japanese)" in the favorite menu in accordance with the flow chart in FIG. 7 under the control of microcomputer 10 will be described with reference to the display images shown in FIGS. 5A to 5F and FIGS. 6A to 6D. Note that "warm up", "milk", "sake" and "defrost meat" are assumed to be preliminarily registered as standard recipe names HN in non-volatile memory 11B at the time of shipment of microwave oven 1 from factories.

First, when power ON key 175 of input unit 15 in FIG. 4 is pressed (step S1 in FIG. 7), "warm up" that is preliminarily registered as a standard recipe name HN at the time of shipment is displayed on LCD panel 13 as shown in FIG. 5A. Thereafter, every time favorite key 173 of input unit 15 is pressed, "milk", "sake" and "defrost meat" of standard recipe names HN preliminarily registered at the time of shipment are displayed as shown in FIGS. 5B to 5D (a loop of steps S2–S4). When favorite key 173 is further pressed, "new" is displayed on LCD panel 13 as shown in FIG. 5E as no standard recipe name HN is stored in non-volatile memory 11B after "defrost meat" of standard recipe name HN (YES in step S4). The display image of FIG. 5E is an image for prompting the user to register his/her favorite standard recipe name HN in the favorite menu in non-volatile memory 11B.

Here, if the user wishes to newly register his/her favorite standard recipe name HN in non-volatile memory 11B and presses key 176 in FIG. 5E, "the Japanese syllabary index" image appears as shown in FIG. 5F (step S6). The display image shown in FIG. 5E is an image for specifying and reading out different kinds of standard recipe names HN preliminarily stored in mask ROM 11A or ROM 103 in the order of the syllabary, for display on LCD panel 13.

When the user desires to register "pot-steamed hotchpotch" of standard recipe name HN in the favorite menu, key 177 for specifying "the Japanese syllable row-TA" in "syllabary index" is pressed in the image of FIG. 5F. This switches the image to FIG. 6A, in which standard recipe names HN belonging to "row-TA" are displayed in the order of the syllabary in a menu format on LCD panel 13 (step S7). As shown, standard recipe names HN are successively displayed, beginning with "plenty vegetables (Tappuriyasai in Japanese)" of standard recipe name HN.

When the user presses key 178 to specify "pot-steamed hotchpotch" of standard recipe name HN in the image of FIG. 6A and presses key 179 to specify registration of standard recipe name HN (YES in step S8), the image in FIG. 6B and thereafter the image in FIG. 6C appear. Thus, it is notified that "pot-steamed hotchpotch" as specified standard recipe name HN is newly registered in non-volatile memory 11B as a favorite menu, and then "pot-steamed hotchpotch" of standard recipe name HN is registered in the favorite menu in non-volatile memory 11B (step S9).

When another standard recipe name HN is to be registered as a favorite menu, key 180 for specifying registration of the next standard recipe name HN may be pressed in the image in FIG. 6C and the above-described operation may be repeated. On the other hand, when the operation to register standard recipe name HN in the favorite menu is finished on the image of FIG. 6C, key 181 for indicating termination of registering operation of standard recipe name HN is pressed to terminate a series of registering operations, and then an image as shown in FIG. 6D appears. The display image of FIG. 6D is an image for prompting the user to input the instruction to start cooking for standard recipe name HN "potsteamed hotchpotch" which has been newly registered in the favorite menu in non-volatile memory 11B now.

When the user wishes to cook "pot-steamed hotchpotch" and operates warm up start key 172 at the time of the image of FIG. 6D appearing, information corresponding to "pot-steamed hotchpotch" of standard recipe name HN (heating information KI, how-to-cook information TI and material information ZI) is read from mask ROM 11A or ROM 103. The read how-to-cook information TI and material information ZI is displayed on LCD panel 13 and heating information KI is provided to microcomputer 10. The user checks the displayed content and sets foodstuff already prepared and precooked in the chamber of microwave oven 1. Then, microcomputer 10 controls heating unit 10B based on heating information KI and starts heating and cooking the foodstuff set in the chamber.

Heating information KI as used herein refers to information of a cooking sequence including a cooking setup for heating and cooking a corresponding standard dish, cooking time, a heating temperature for cooking, a microwave output level by magnetron 65, a heating temperature of heater 64.

Standard recipe name HN displayed on LCD panel 13 when favorite key 173 of input unit 15 is pressed is larger letters as shown in FIGS. 5A to 5F and FIGS. 6A to 6D, as compared with the standard recipe name HN selected with a normal key operation. This will be described with reference to the figures.

FIGS. 8A to 8G illustrate the display images of the favorite menu in the first embodiment of the present invention. FIGS. 8B to 8G show the images which are displayed, from selection of a desired standard recipe name HN "pot-steamed hotchpotch" from different kinds of standard recipe names HN preliminarily registered in mask ROM 11A or ROM 103, to start of cooking. Specifically, when the user presses cooking menu key 171 of input unit 15, the image shown in FIG. 8B appears on LCD panel 13.

Different kinds of standard recipe names HN preliminarily registered in mask ROM 11A or ROM 103 are classified into different kinds of groups in accordance with the cooking content, and each name of groups is shown in the image of FIG. 8B of LCD panel 13. As "pot-steamed hotchpotch" belongs to the group of "steamed food/stewed beans", the user touches key 182 corresponding to the group of "steamed food/stewed beans", and the image in FIG. 8C then appears. The image of FIG. 8C shows a plurality of standard recipe names HN belonging to the group of "steamed food/stewed beans", among which the user touches key 182A corresponding to the desired standard recipe name HN "pot-steamed hotchpotch". Then, the image of FIG. 8D for prompting the user to input the instruction to start cooking using heating information KI corresponding to the desired standard recipe name HN "pot-steamed hotchpotch" is displayed.

When the user presses warm up start key 172 to instruct start of cooking in response to the image of FIG. 8D appearing, an image for selecting a finished state of cooking is displayed as shown in FIG. 8E, and thereafter cooking proceeds while the elapsed time of heating and cooking is being displayed as shown in FIG. 8F. When heating and cooking is finished, an image for notifying that heating and cooking is finished is displayed as shown in FIG. 8G.

On the other hand, when the user has preliminarily registered his/her favorite standard recipe name HN "pot-steamed hotchpotch" in non-volatile memory 11B as a favorite menu in accordance with the above-described procedures in FIGS. 5A to 5F and FIGS. 6A to 6D, the following operations will be performed. Specifically, when the user wishes to cook the standard dish "pot-steamed hotchpotch", the user pushes favorite key 173 of input unit 15 four times, so that the images of FIGS. 5A to 5D are successively switched and displayed and then the image of FIG. 8A is displayed. The display image of FIG. 8A is an image for prompting an input of the instruction to cook the desired standard dish "pot-steamed hotchpotch" in accordance with heating information KI corresponding to that desired standard dish. When the user presses warm up start key 172 of input unit 15 in response to the image of FIG. 8A appearing, the images of FIGS. 8E to 8G are successively displayed and cooking of the desired "pot-steamed hotchpotch" proceeds and ends, as described above.

When the user presses favorite key 173, standard recipe name HN is displayed in larger characters as shown in FIG. 8A as compared with the standard recipe name HN selected with a normal key operation (FIGS. 8B to 8D), so that even the elder user could identify a displayed standard recipe name HN quickly and accurately.

In comparison with the operational procedures in FIGS. 8B to 8D, the operational procedure shown in FIG. 8A enables designation of a desired standard recipe name HN and start of cooking of the corresponding standard dish by a simpler operation of pressing favorite key 173 successively four times. Therefore, it is highly practical even for the elder user to cook a favorite standard dish.

The display image of FIG. 8A is a dedicated image for displaying standard recipe name HN in large characters and for displaying a message as required only for a favorite dish selected by operating "favorite" key 173 as appreciated in comparison with the display images in FIGS. 8B to 8D. Provision of such a dedicated image enables display of a precautionary statement for elderly people, in case the user is elder, and of special advice on cooking a standard dish, resulting in high practicability for the user. Such a dedicated image is an image for displaying a message unique to each dish that is prepared for each of standard recipe names HN registered as favorite menus in non-volatile memory 11B.

FIGS. 9A to 9E illustrate a procedure to delete a standard recipe name preliminarily registered in the first embodiment. FIG. 10 is a process flow chart for deleting a standard recipe name preliminarily registered in the first embodiment. The procedure to delete a standard recipe name preliminarily registered, under the control of microcomputer 10 will be described according to the flow chart in FIG. 10 and with reference to FIGS. 9A to 9E. The procedure to delete "milk" from the standard recipe names HN preliminarily registered in non-volatile memory 11B will be described herein.

As power ON key 175 of input unit 15 is first pressed, microcomputer 10 displays the image of FIG. 8A. As favorite key 173 is then pressed, microcomputer 10 reads "milk" of standard recipe name HN from non-volatile memory 11B to display the image of FIG. 9B (steps S10 and S11 in FIG. 10).

Figure 9A:
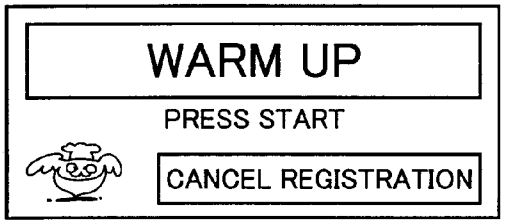
FIGS. 9A to 9E illustrate the procedures for deleting a standard recipe name preliminarily registered in the first embodiment.
Figure 9B:
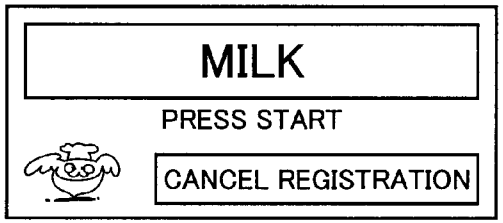
Figure 9C:
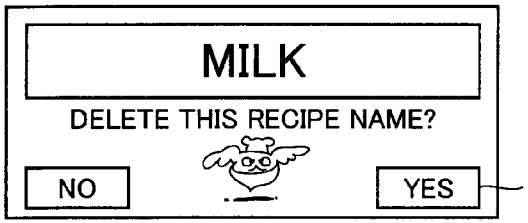

When "milk" of standard recipe name HN displayed in FIG. 9B is to be deleted from non-volatile memory 11B, as the user touches key 183 to instruct deletion of the registration in FIG. 9B (YES at step S12), microcomputer 10 displays the image shown in FIG. 9C and outputs a message "DELETE THIS RECEIPE NAME?". As the user who wishes to delete "milk" of standard recipe name HN touches key 184 on this image ("YES" at step S13), microcomputer 10 displays the image of FIG. 9D and deletes "milk" of standard recipe name HN from the image while deleting "milk" of the standard recipe name HN from non-volatile memory 11B to display a message "DELETED" on the image (step S14).

Figure 9D:
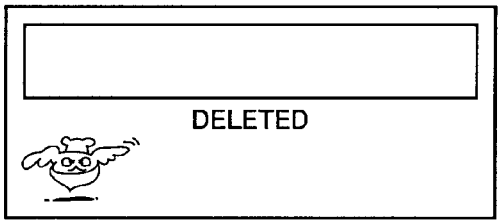
Figure 9E:
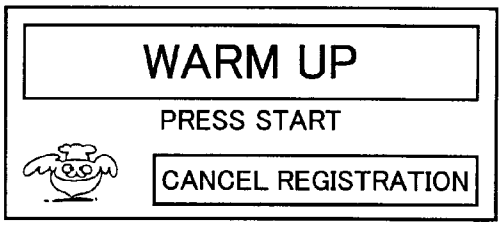
Figure 10:
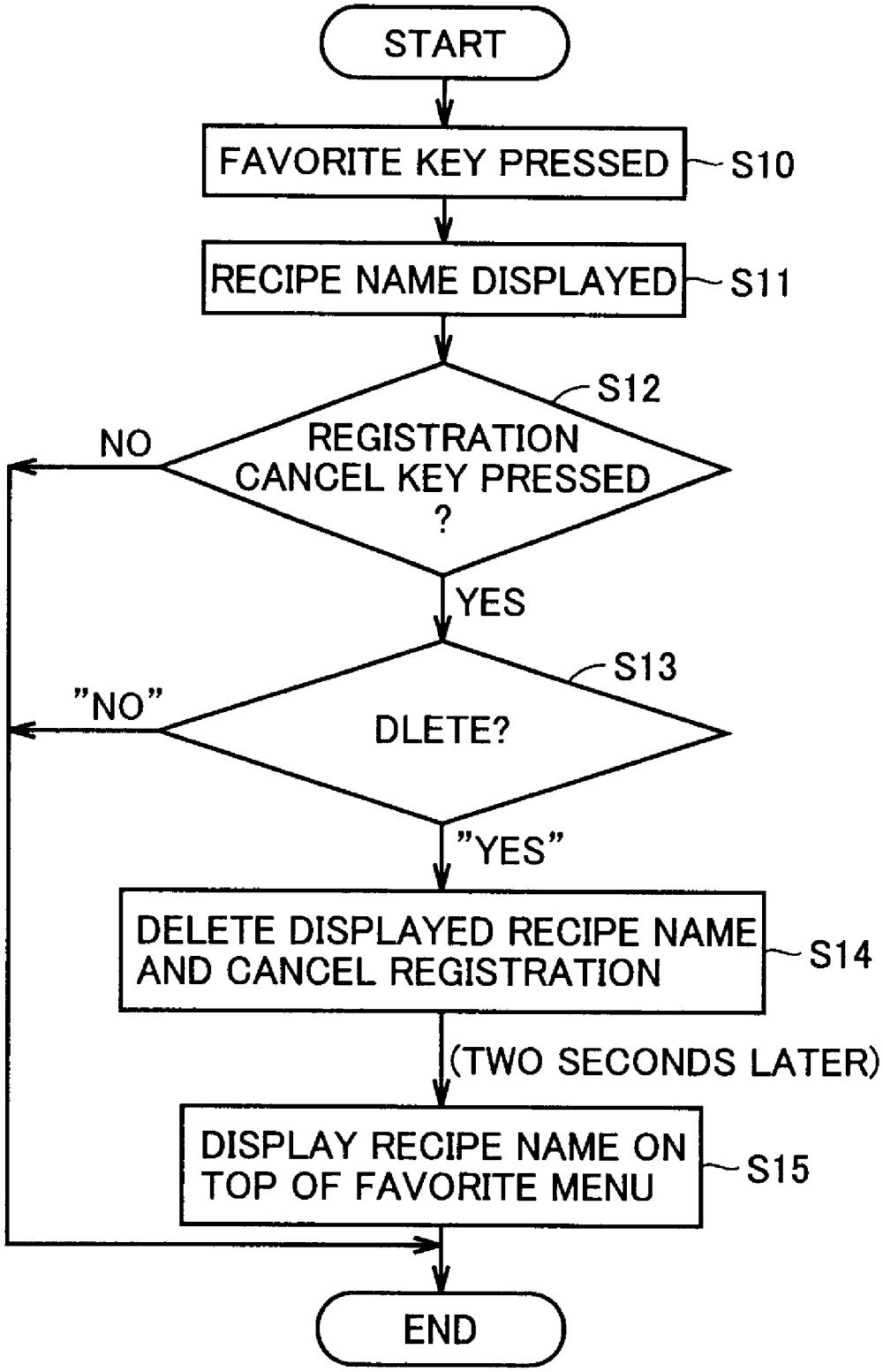
FIG. 10 is a process flow chart for deleting a standard recipe name preliminarily registered in the first embodiment.

After the image of FIG. 9D is displayed, for example two seconds later, an image for displaying a standard recipe name registered at the top of the favorite menu in non-volatile memory 11B, for example "warm up" (see FIG. 9E), is displayed.

A desired standard recipe name HN in the favorite menu preliminarily registered in non-volatile memory 11B can thus easily be deleted. Therefore, it becomes possible to delete a standard recipe name HN less frequently used for cooking, for example, not used at all for cooking from non-volatile memory 11B and to register a new standard recipe name HN in the resulting space area in non-volatile memory 11B. Thus, the content of the favorite menu in non-volatile memory 11B can be changed arbitrarily and easily as desired by the user.

The above-described microwave oven 1 has a following feature. Specifically, it is characterized in that information for each of finished servings concerning a corresponding standard dish is included in cooking information CI and the corresponding servings information is displayed using a corresponding standard recipe name HN. For example, as shown for a standard dish "sponge cake" in FIG. 2, for each of four kinds of servings, heating information KI, how-to-cook information TI and material information ZI corresponding to the servings is individually set.

Figure 12:
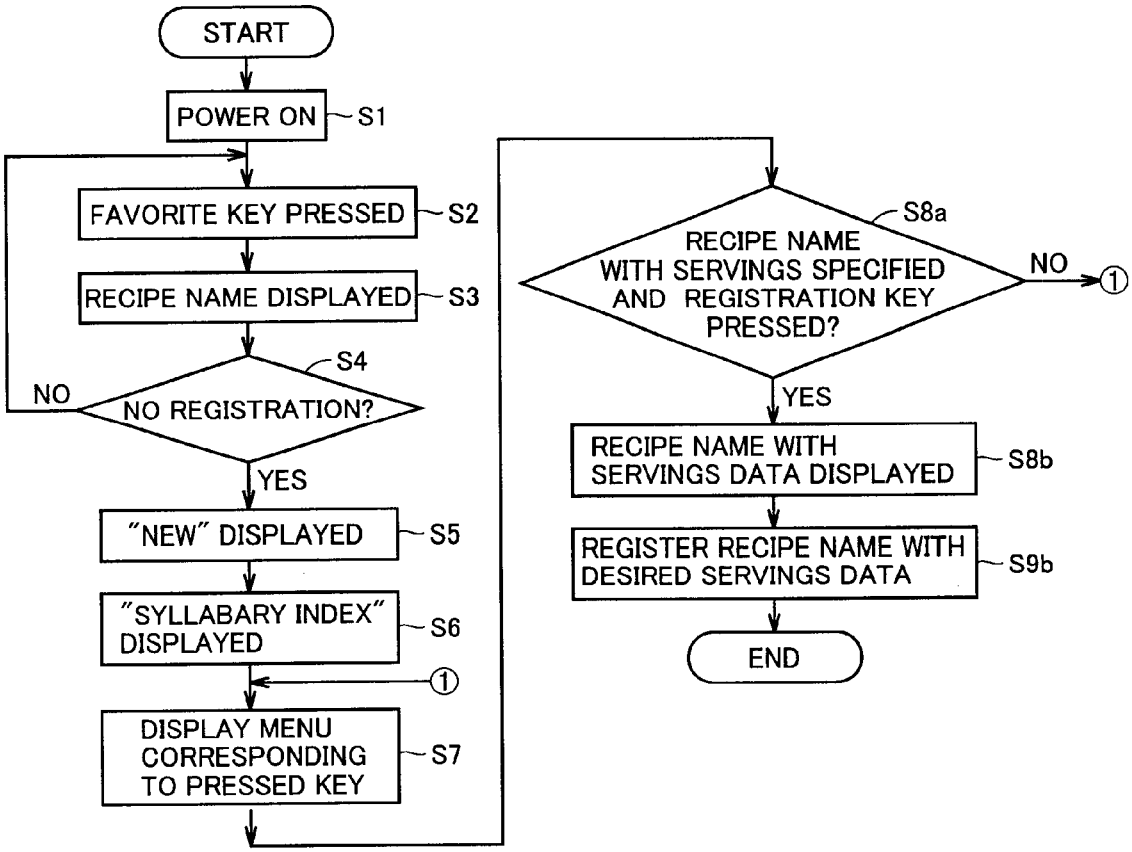
FIG. 12 is a processing flow chart for registering a standard recipe name indicative of the servings of a dish into the favorite menu in accordance with the first embodiment of the present invention.

FIGS. 11A to 11G show exemplary on-screen displays illustrating a procedure for registering a standard recipe name indicative of the servings of the dish into the favorite menu in the first embodiment. FIG. 12 is a process flow chart for registering a standard recipe name indicative of the servings of the dish into the favorite menu in the first embodiment.

The process in accordance with the flow chart in FIG. 12 under the control of microcomputer 10 will be described with reference to FIGS. 11A to 11G. First, as the user presses power ON key 175 of input unit 15 and successively presses favorite key 173, microcomputer 10 displays the image of FIG. 11A on LCD panel 13 (steps S1 to S5 in FIG. 12).

When key 176 is pressed to instruct a new registration of a standard recipe name HN on the image of FIG. 11A, microcomputer 10 displays the "syllabary index" image in FIG. 11B (step S6). Here, as the user touches key 185 indicating "the Japanese syllable row-SA" in FIG. 11B in order to specify "sponge cake" of standard dish name HN of which registration is desired, microcomputer 10 displays the image of FIG. 11C for displaying a menu of standard recipe names HN belonging to "SA" (step S7). When the user touches key 185A corresponding to "sponge cake" in the menu, that standard recipe name HN is highlighted to notify that it has been specified on the image of FIG. 11D. Here, as the user touches key 179 instructing registration (YES at step S8*a*), microcomputer 10 displays the image shown in FIG. 11E (step S8*b*).

In this microwave oven 1, as shown in mask ROM 11A or ROM 103 in FIG. 2, four kinds of standard recipe names corresponding to the standard dish "sponge cake" are registered. In the microwave oven 1, for example, a first kind of standard recipe name HN "sponge cake" designates a sponge cake of "18 cm" size on one tray, a second kind of standard recipe name HN "sponge cake" designates a sponge cake of "21 cm" size on one tray, a third kind of standard recipe name HN "sponge cake" designates sponge cakes of "15 cm" and "21 cm" sizes on two trays, and a fourth kind of standard recipe name HN "sponge cake" designates sponge cakes of "18 cm and 18 cm" sizes on two trays. In the display image of FIG. 11E, an image for prompting selection of any of those four kinds of standard recipe names HN "sponge cake" read from mask ROM 11A or ROM 103 is displayed. For example, when the user wishes to cook the sponge cake of "18 cm" size on one tray and touches the corresponding key 1791 in the display image of FIG. 11E, the specified standard recipe name HN "sponge cake/18 cm" is read from mask ROM 11A or ROM 103 and registered in non-volatile memory 11B, and the image of FIG. 11F is displayed (steps S8*b* and S9*b*).

On the display image of FIG. 11F, a message of "NEWLY REGISTERED" is displayed to indicate that the standard recipe name HN "sponge cake/18 cm" has been registered in non-volatile memory 11B. Thereafter, when key 181 instructing completion of registration is touched, the image of FIG. 11G is displayed. When the standard recipe name HN "sponge cake" is selected, an input of the instruction to start cooking for the standard recipe name "sponge cake/18 cm" is prompted as shown in FIG. 11G.

Similarly, it is possible to newly register standard recipe name HN "sponge cake/21 cm". In this way, even for the same standard recipe name HN ("sponge cake"), different standard recipe names HN for each different finished servings of that dish can be registered in non-volatile memory 11B.

On the display image of FIG. 11E, when key 186 for requesting how-to-cook information is touched, the corresponding how-to-cook information TI in FIG. 2 is read out and displayed on the image. Therefore, the user can readily check how to cook a desired standard dish on the spot without looking at a cookbook.

Since every user is targeted in the first embodiment described above, heating information KI and the like concerning a large number of standard dishes is stored in mask ROM 11A or ROM 103 of microwave oven 1. The standard dishes which each user may cook, however, are generally limited to several of them. If a desired standard recipe name HN can arbitrarily be registered in the favorite menu as in the first embodiment, the favorite standard dish frequently cooked can easily be selected and cooked. Therefore, even if the user is an elderly person, the elder user can perform an operation for selecting and cooking a favorite standard dish in a very easy manner simply by displaying a piece of advice such as "PRESS FAVORITE KEY THREE TIMES", resulting in practical performance.

Figure 13A:
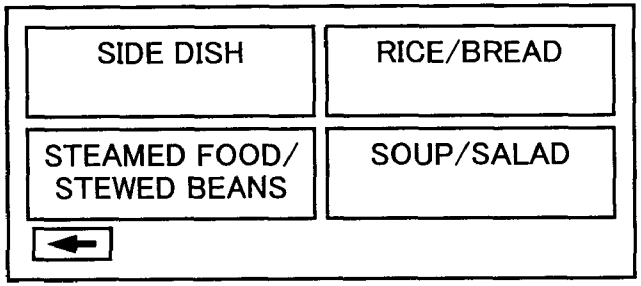
FIGS. 13A to 13C illustrate how designation of a desired standard recipe name HN is simplified in accordance with the first embodiment.
Figure 13B:
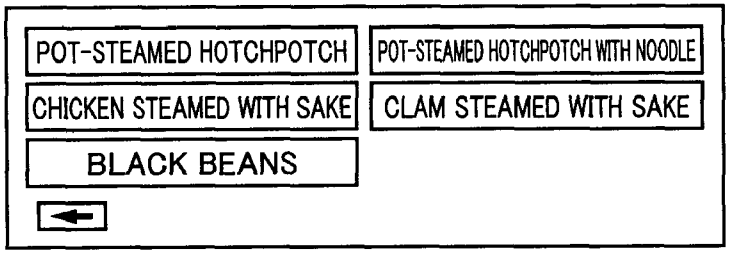
Figure 13C:
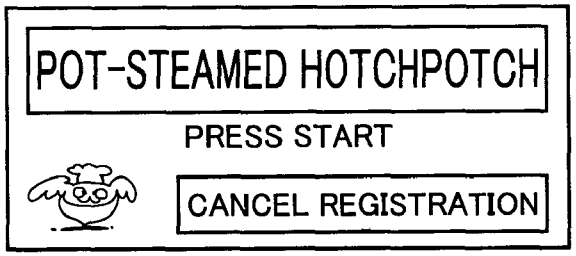

FIGS. 13A to 13C illustrate how designation of a desired recipe name HN is simplified in accordance with the first embodiment. For example, assume an elderly household fond of "pot-steamed hotchpotch" of standard recipe name HN. When the registration operation in the first embodiment is not performed, in order to specify "pot-steamed hotchpotch" of standard recipe name HN, an operation for reading and specifying that standard recipe name HN from mask ROM 11A or ROM 103 is required (see FIGS. 13A and 13B). On the other hand, according to the first embodiment, once "pot-steamed hotchpotch" of standard recipe name HN is registered at the top of the favorite menu in non-volatile memory 11B in accordance with the above-described procedure, "pot-steamed hotchpotch" of a desired standard recipe name HN can be selected and specified for a quick operation of cooking only by pushing favorite key 173 once, as shown in FIG. 13C.

Second Embodiment

A second embodiment will now be described. Microwave oven 1 shown in the first embodiment described above is not limited to a stand-alone basis but can be used in connection with an external device via communication.

Figure 14:
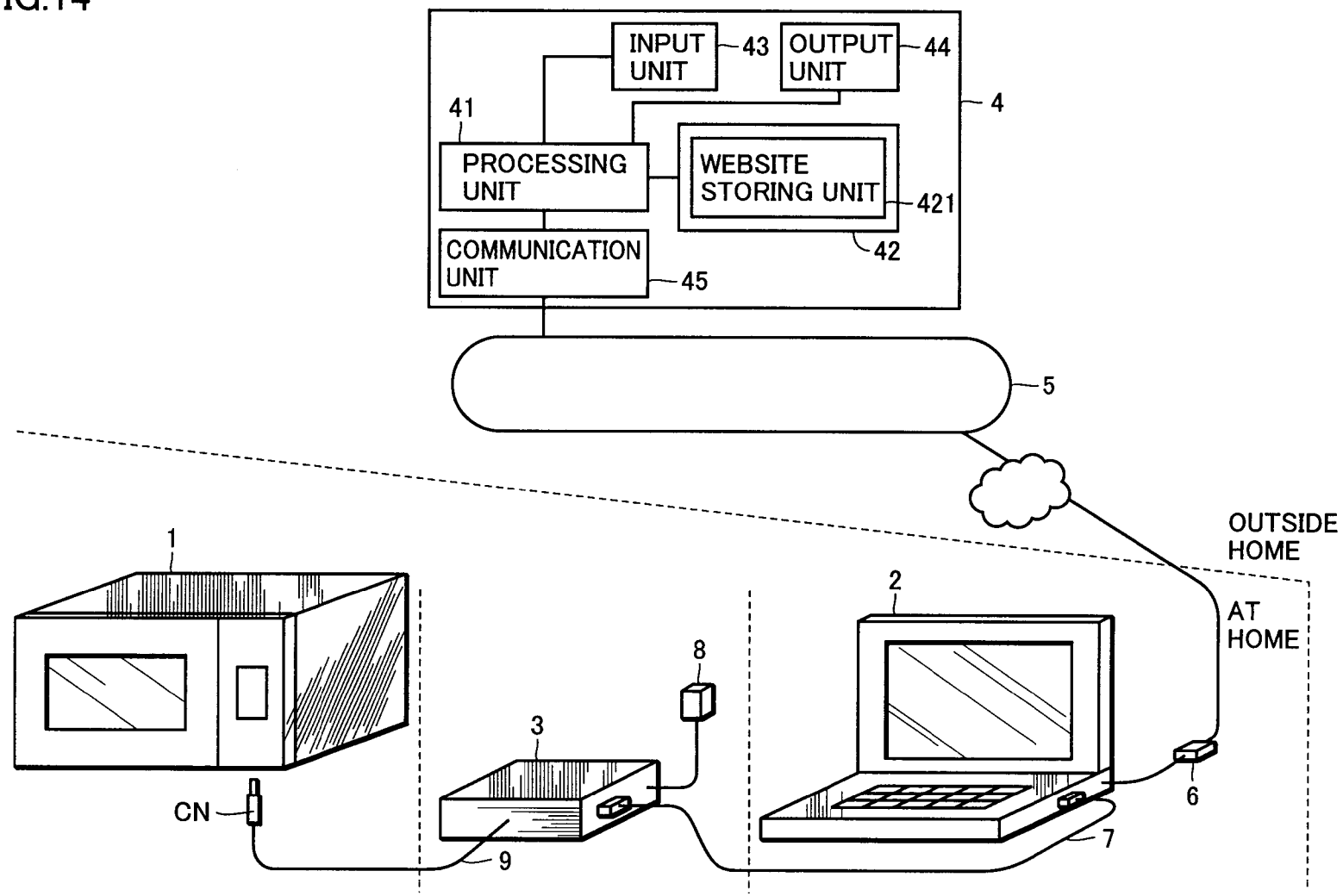
FIG. 14 shows a schematic configuration of a microwave oven system in accordance with a second embodiment.

FIG. 14 schematically shows the configuration of a microwave oven system in accordance with the second embodiment. In FIG. 14, the microwave oven system is provided with Internet 5 and a host computer 4 connected therewith outside home, and is provided with microwave oven 1, a personal computer 2 connected with Internet 5 through a modem 6, and a relay BOX 3 powered from an AC adapter 8, which is a relay device for relaying communication while converting a signal between personal computer 2 and microwave oven 1 for connection therebetween, at home. At home, microwave oven 1 is connected with relay BOX 3 through three-line cable 9. In connection, a connector CN at one end of three-line cable 9 is connected to an input/output terminal (not shown) of I/F unit 14 of microwave oven 1 as can be seen from the figure. Furthermore, at home, personal computer 2 is connected to relay BOX 3 through RS-232C cable 7 for communication in accordance with RS-232C.

Information concerning a variety of websites accessed through Internet 5 is registered in host computer 4 outside home. Host computer 4 includes a processing unit 41 for centrally controlling and managing the host computer 4 itself, memory 42 having a website storing unit 421 that is a memory area into which information including information constructing display images of a website (referred to website information hereinafter) is stored, an input unit 43, an output unit 44, and a communication unit 45 for connecting host computer 4 with Internet 5 via communication.

Stored in website storing unit 421 are cooking data directly recognizable by microwave oven 1, including heating control data (corresponding to heating information KI) corresponding to each of different dishes for cooking the dish by microwave oven 1, and image data for constructing and displaying on personal computer 2 a website image with a button operated to transfer cooking data to personal computer 2 through Internet 5 and information concerning the dish. Therefore, in case of cooking using the heating control data of a desired dish that is supplied and downloaded on personal computer 2, when Internet menu key 174 in FIG. 2 is pressed, a list of recipe names downloaded onto personal computer 2 through Internet 5 is displayed on LCD panel 13 through relay BOX 3. When the user specifies his/her desired recipe name among the list as displayed, the heating control data downloaded corresponding to that recipe name is provided from personal computer 2 through relay BOX 3 to microwave oven 1. Accordingly, when warm up start key 172 is pressed, the dish can be cooked in microwave oven 1.

Microwave oven 1 illustrated in the first embodiment can also cook a desired dish provided in website information in accordance with heating control data downloaded from website information.

Note that though Internet 5 is illustrated here, the present invention is not limited thereto, and various kinds of communication networks can be employed.

Furthermore, though personal computer 2 is shown herein connected to microwave oven 1 through relay BOX 3, personal computer 2 may be connected to microwave oven 1 not through relay BOX 3 but through infrared communication, and thus personal computer 2 may also function as relay BOX 3.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A microwave oven comprising a storing unit at which cooking information including heating control information corresponding to each of a plurality of dishes for cooking the dishes is registered as a standard, the microwave oven further comprising:

a display unit;

recipe name storing means storing preset recipes and recipe names of one or more dishes selected from said plurality of dishes;

an external operation unit having at least a read operation unit operated to read said preset recipes and selected recipe names as desired from said recipe names in said recipe name storing means for successive display on said display unit, and a heating start operation unit operated to instruct start of a heating operation for cooking;

desired recipe name displaying means displaying on said display unit said desired recipe name read from said recipe name storing means in response to said read operation unit being operated; and desired dish heating means for starting said heating operation in accordance with said heating control information corresponding to said dish of said desired recipe name, in response to said heating start operation unit being operated, when said desired recipe name is displayed on said display unit by said desired recipe name displaying means.

2. The microwave oven according to claim 1, wherein said desired recipe name displaying means displays said desired recipe name in larger letters on said display unit.

3. The microwave oven according to claim 1, wherein said recipe name corresponding to each of said plurality of dishes registered as a standard is further included in said cooking information, the microwave oven further comprising recipe name storing control means reading said recipe name of a desired dish from said storing unit through said external operation unit and storing it into said recipe name storing means.

4. The microwave oven according to claim 1, further comprising recipe name deletion control means deleting from said recipe name storing means said recipe name selected through said external operation unit.

5. The microwave oven according to claim 1, wherein said desired recipe name displaying means displays said desired recipe name using a corresponding dedicated image on said display unit, wherein the dedicated image is of an unique size and/or color together with a tip message on cooking.

6. The microwave oven according to claim 1, wherein said cooking information presents the content depending on servings of corresponding said dish, and corresponding said servings are indicated using said recipe name.

7. The microwave oven according to claim 1, wherein said heating operation is started to cook a prescribed dish in accordance with said heating control information of said prescribed dish that is supplied from website information via a communication network.

* * * * *